United States Patent [19]

Satti

[11] 4,189,693

[45] Feb. 19, 1980

[54] SUPERCONDUCTING MAGNET

[75] Inventor: John A. Satti, Naperville, Ill.

[73] Assignee: The United States of America as represented by the United States Department of Energy, Washington, D.C.

[21] Appl. No.: 865,345

[22] Filed: Dec. 28, 1977

[51] Int. Cl.[2] ..... H01F 7/22

[52] U.S. Cl. ..... 335/216; 174/128 S

[58] Field of Search ..... 174/126 S, 128 S; 335/216

[56] References Cited

U.S. PATENT DOCUMENTS

| | | | |
|---|---|---|---|
| 3,356,976 | 12/1967 | Sampson et al. | 335/216 |
| 3,431,523 | 3/1969 | Donadieu | 335/216 X |
| 3,626,341 | 12/1971 | Dao | 335/216 |
| 3,731,241 | 5/1973 | Coupland | 335/216 X |

*Primary Examiner*—George Harris

*Attorney, Agent, or Firm*—R. V. Lupo; Frank H. Jackson; Donald P. Reynolds

[57] ABSTRACT

A superconducting magnet designed to produce magnetic flux densities of the order of 4 to 5 Webers per square meter is constructed by first forming a cable of a plurality of matrixed superconductor wires with each wire of the plurality insulated from each other one. The cable is shaped into a rectangular cross-section and is wound with tape in an open spiral to create cooling channels. Coils are wound in a calculated pattern in saddle shapes to produce desired fields, such as dipoles, quadrupoles, and the like. Wedges are inserted between adjacent cables as needed to maintain substantially radial placement of the long dimensions of cross sections of the cables. After winding, individual strands in each of the cables are brought out to terminals and are interconnected to place all of the strands in series and to maximize the propagation of a quench by alternating conduction from an inner layer to an outer layer and from top half to bottom half as often as possible. Individual layers are separated from others by spiraled aluminum spacers to facilitate cooling. The wound coil is wrapped with an epoxy tape that is cured by heat and then machined to an interference fit with an outer aluminum pipe which is then affixed securely to the assembled coil by heating it to make a shrink fit. In an alternate embodiment, one wire of the cable is made of copper or the like to be heated externally to propagate a quench.

2 Claims, 8 Drawing Figures

SUPERCONDUCTING MAGNET

CONTRACTURAL ORIGIN OF THE INVENTION

The invention described herein was made in the course of, or under, a contract with the UNITED STATES DEPARTMENT OF ENERGY.

BACKGROUND OF THE INVENTION

This invention relates to superconducting magnets. Superconducting magnets of various kinds must be constructed so that they are not destroyed by the electrical energy that must be dissipated when they are quenched. Such coils must also be built to withstand the extremely large forces that are generated by interactions among parallel currents of large values. In addition, superconducting electromagnets are nearly always subject to some degree of training which is the phenomenon in which the quench current is smaller than the design value when the magnet is first used, approaching the design value asymptotically as the magnet is alternately quenched and cooled.

The foregoing problems are common to superconducting magnets whatever their intended use. Superconducting magnets intended for use on particle accelerators must, in addition, be able to dissipate the deposited energy that is associated with the presence of occasional stray particles of high energy.

It is an object of the present invention to provide a better superconducting magnet.

It is a further object of the present invention to provide a design for a superconducting magnet that propagates a quench effectively.

It is a further object of the present invention to provide a superconducting magnet that is wound with cable having the current in all cable strands in series.

It is a further object of the present invention to provide a superconducting magnet with effective circulation of the cooling material.

Other objects will become apparent in the course of a detailed description of the invention.

SUMMARY OF THE INVENTION

A superconducting magnet is wound in a saddle configuration by forming a twisted rectangular cable of a plurality of strands of matrix superconducting wire. The cables are wound in a saddle shape on the outer surface of a cylinder according to a predetermined pattern. Layers are wound in pairs so that there is one cable termination per layer. Ends of individual strands are brought out to terminals and interconnections are made to place all individual strands in series and to propagate a quench as fast as possible throughout the magnet by alternating connections from layer to layer and from top to bottom. Both the twist in the cabling of strands and the placement of spiral spacers in the winding facilitate circulation of a cooling fluid such as liquid helium. The wound coil is machined to an interference fit with and is formed into a shrink fit with an enclosing cylindrical metal tube. In an alternate embodiment, one strand of the cable is made of a normal conductor such as copper for connection to an external source as a heater.

DETAILED DESCRIPTION OF THE INVENTION

Figure 1:
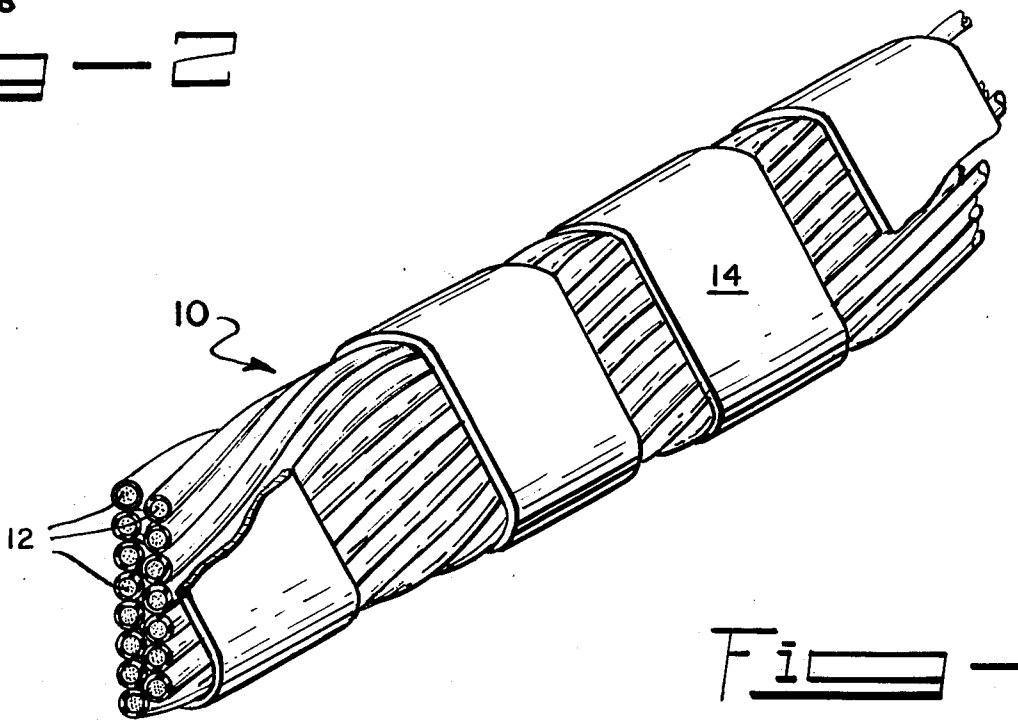
FIG. 1 is an isometric view of a cable used to wind the magnet of the present invention.

FIG. 1 is a perspective view of a cut portion of the cable 10 that is used to wind the superconducting magnet of the present invention. Cable 10 is formed of an odd number of strands 12 of a matrix superconducting material that has been twisted into a spiral shape and formed to a cross-section that is substantially rectangular. Tape 14 is a glass type impregnated with epoxy resin that is combined with the twist of strands 12 in an open spiral winding to assist in maintaining the shape of the cable and to provide separation between stacked cables for the passage of a cooling fluid such as liquid helium. The twist of the spiral of strands 12 that is evident in FIG. 1 also permits the passage of the cooling fluid along adjacent strands 12 for cooling. Each, or each but one, of the strands 12 comprises a plurality of filaments of a superconducting material such as niobium-titanium that is placed in a good normal electrical conductor such as copper and drawn to a desired size. Each such strand 12 is then insulated electrically with an insulating coating that will withstand the cabling and shaping process and still insulate one strand 12 from another. FIG. 1 shows fifteen strands 12 but this number is a matter of convenient choice as long as the number chosen is odd to permit each strand 12 in one vertical row to lie tangent to two strands 12 in the other vertical row. The twist of the strands 12 shown in FIG. 1 serves three functions. First, it provides a degree of rigidity in holding the cable together in its rectangular shape. Second, it assists in the propagation of a developing quench from one side of the cable to another and hence assists somewhat in propagating the quench to adjacent cables on both sides. If a strand of normal conductor is used, a quench is propagated also by heating the the normal strand. Finally, the twist provides diagonal passages for cooling fluids in the interstices between and among adjacent paralleled strands 12. The particular cable 10 shown in FIG. 1 has fifteen strands 12 but such cables can be made in a rectangular cross-section with numbers of strands ranging at least from five to twenty-three. Below about five strands the cable does not hold its shape well and it becomes difficult to maintain a two-layer rectangle above twenty-three or so strands.

Figure 2:
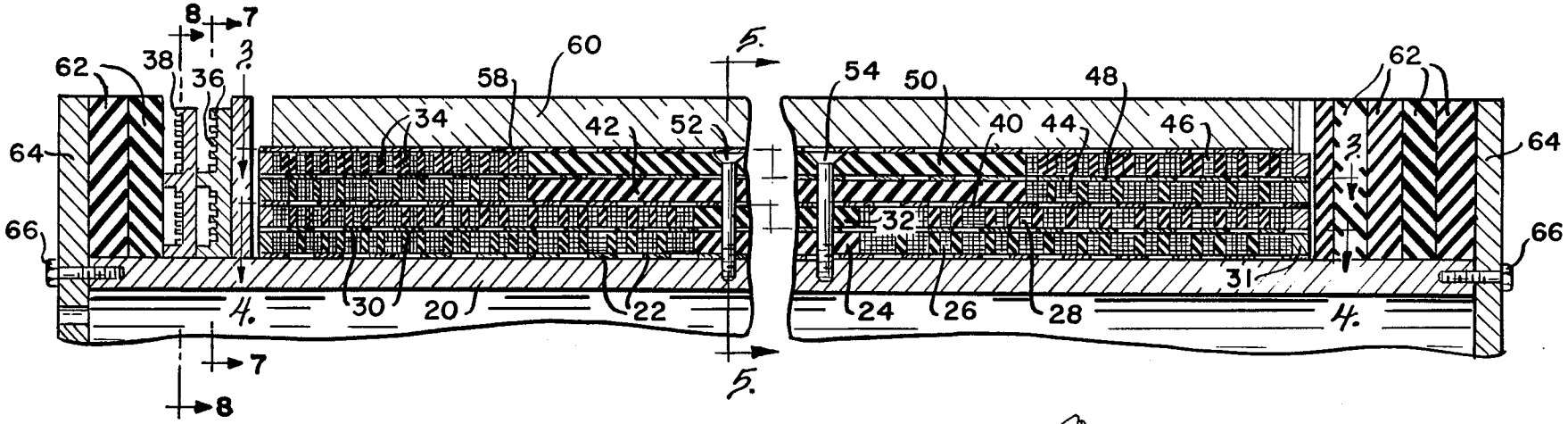
FIG. 2 is a sectional side view of a set of coils of the dipole magnet of the present invention.
Figure 3:
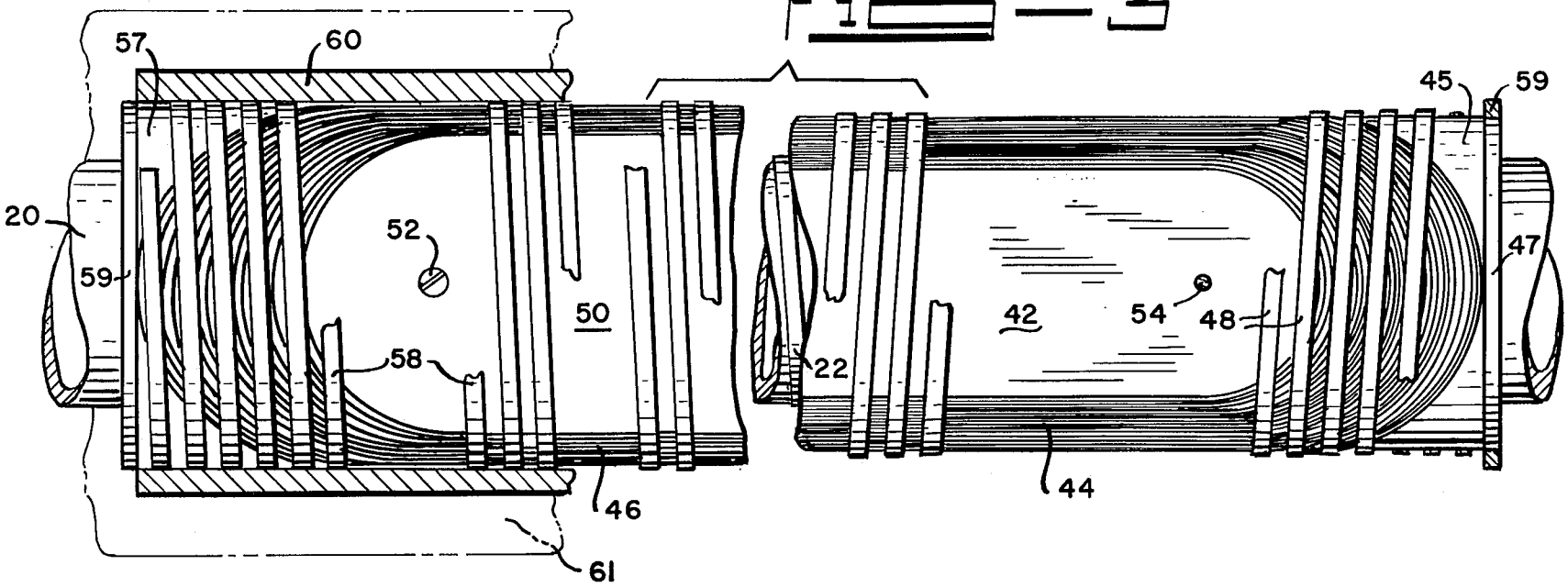
FIG. 3 is a partial top view of the coil of FIG. 2 taken along lines 3—3 to show the top two layers.
Figure 4:
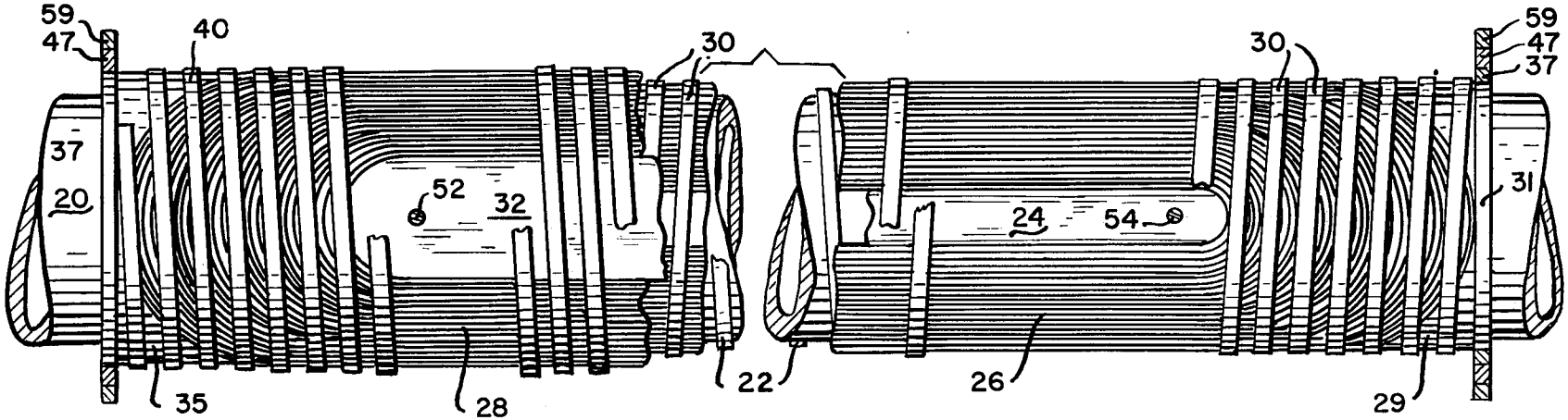
FIG. 4 is a partial top view of the coil of FIG. 2 taken along lines 4—4 to show the bottom two layers.

The cable 10 of FIG. 1 is used to wind a superconducting dipole magnet in the form shown by FIGS. 2, 3 and 4. FIG. 2 is a sectional side view of a set of wound coils for the practice of the present invention. FIG. 3 is a partial sectional top view of the coil of FIG. 2 taken along section lines 3—3 of FIG. 2 and FIG. 4 is a partial sectional top view of the coil of FIG. 2 taken along section lines 4—4 of FIG. 2. The views in FIGS. 2, 3 and 4 show one four-layer saddle winding that comprises one-half of a superconducting dipole. A bore tube 20 of stainless steel or the like serves as a main supporting fixture when the coils are wound and also comprises a passage through which an eventual beam of charged particles will pass, and a similar four-layer winding disposed symmetrically on the opposite side of bore tube to comprise a dipole. The superconducting windings are to be kept in a cryogenic environment by cryogenic means 61.

Construction of a dipole begins with the winding of a strip 22 of aluminum or some other good conductor of heat in an open spiral along the outside of bore tube 20 over the length to be spanned by the windings of the superconducting dipole magnet. The spacings between adjacent strips in the spiral winding will provide passages for the circulation of a coolant such as liquid helium in the completed magnet, and the material of strip 22 will facilitate the conduction of heat. The next step in preparation of a coil is to affix a first spacer 24 to bore tube 20. This is a saddle-shaped portion of a cylindrical shell made of an epoxied glass fiber and placed tangent to bore tube 20. A first layer 26 is wound in a saddle shape on the outer circumference of bore tube 20 as shown in FIGS. 2 and 4. The cables in first layer 26 are wound so that the short dimension of their rectangular cross-section is tangent to bore tube 20. While it is not necessary for the practice of this invention, it is convenient from a constructional standpoint to wind the first layer 26 and the second layer 28 from a continuous piece of cable. This is readily accomplished by taking a superconducting cable of a length necessary to complete first layer 26 and second layer 28, winding inward from one end of the cable on one spool a length sufficient for first layer 26 and winding inward from the other end of the cable on a second spool an amount necessary for second layer 28. Winding of first layer 26 then begins from a common location between the two spools and the spool holding the cable for second layer 28 is suspended and permitted to rotate while first layer 26 is wound. After first layer 26 is wound, epoxy spacer 29 is placed to fill out the shape of a cylinder and end spacers 31 are attached. The assembly is then clamped in a compression fixture and heated to a temperature in the range of 250°-300° F. (400 to 430 K) for about two hours to cure the epoxy resin.

Strip 30, of aluminum or the like, is next wound in an open spiral about the outside of first layer 26 to provide a set of cooling channels. Second spacer 32 is attached over strip 30 and second layer 28 is wound in a saddle shape over the outside of strip 30 using second spacer 32 as a form. It will usually be desirable in constructing a dipole to have fewer windings in second layer 28 than in first layer 26. This will necessitate the placement of occasional spacers 34, of epoxied glass fiber or the like, in a volume equal to the difference in volume between the cross-sectional area of first layer 26 and that of second layer 28. Similar spacers such as spacer 35 will be used where necessary to fill the structure and prevent movement. An example of such a need for spacers not shown here is the transition region where the continuous winding is brought from the level of first layer 26 to that of second layer 28. During this transition, the cable is wedged as necessary with wedges of epoxied glass fibers to fill void spaces and end spacer 37 is attached. The completed second layer 28 is cured in the same way as the first layer 26.

The result of the foregoing procedure is a pair of two-layer saddle-shaped windings disposed symmetrically on opposite sides of bore tube 20. Each of the windings has two ends that will be brought out and connected to terminal 36 or 38 as described below. A procedure analogous to that just described is followed to complete the dipole. A strip 40 of aluminum or the like is wound in an open spiral about second layer 28. As before, the openings in the spiral of strip 40 will provide passages for the circulation of coolant, and the material will conduct heat. Third spacer 42, a shaped section of a cylinder also formed of glass fibers bonded with an epoxy resin, is placed over strip 40 and tangent to it. Third layer 44 is wound in a saddle shape about third spacer 42 on the surface of a cylinder that is concentric with bore tube 20. Spacer 45 fills out the cylindrical shape and end spacer 47 serves as a retainer. Third layer 44 and fourth layer 46 are wound in a fashion similar to that of first layer 26 and second layer 28. That is to say, a length of superconducting cable equal to the total length required for third layer 44 and fourth layer 46 is wound on two spools such that a length necessary for third layer 44 is on one spool and that necessary for fourth layer 46 is on another spool and the winding of third layer 44 is begun from a point between the two spools. As before, third layer 44 is wound so that the short dimensions of the rectangular cross-section of the cable are tangent to a cylinder that is concentric with bore tube 20. After third layer 44 is wound with the required number of turns as calculated and is filled to a cylindrical shape with spacer 45, it is clamped and heated to cure the epoxy and a strip 48 is wound in an open spiral over the cured layer as before. A fourth spacer 50 of glass fiber bonded with epoxy resin and comprising a portion of a cylindrical shell is attached over strip 48 and is secured with screws 52 and 54 which are screwed into holes tapped into but not drilled through bore tube 20. The same tapped holes will have been used previously with shorter screws to hold first spacer 24, second spacer 32 and third spacer 42 in place temporarily during winding and curing. Fourth layer 46 is now wound in a saddle shape to a required number of turns with wedges 56 placed as necessary to fill the volume of the windings. As before, the two ends of the cable are brought out, one from third layer 44 and one from fourth layer 46 for connection to terminals 36 and 38. The cylindrical shape is maintained with spacer 57 and end spacer 59, and the assembly is heated in a compression fixture to cure the epoxy. The compression fixture is then removed and a final set of cooling channels is formed by winding a strip 58 of glass tape impregnated with epoxy resin in an open spiral about the outside of fourth layer 46. Strip 58 is then cured by heating. The cylindrical structure is completed by clamping tube 60, an aluminum pipe that is machined to an interference fit with the cured structure and is heat-shrunk onto the outside to maintain a rigid structure. Axial rigidity is maintained by inserting as many hollow epoxy disks 62 as are necessary to make a tight structure along the length of bore tube 20. Two end clamps 64 are affixed to bore tube 20 by screws 66 to maintain the rigid structure.

Figure 5:
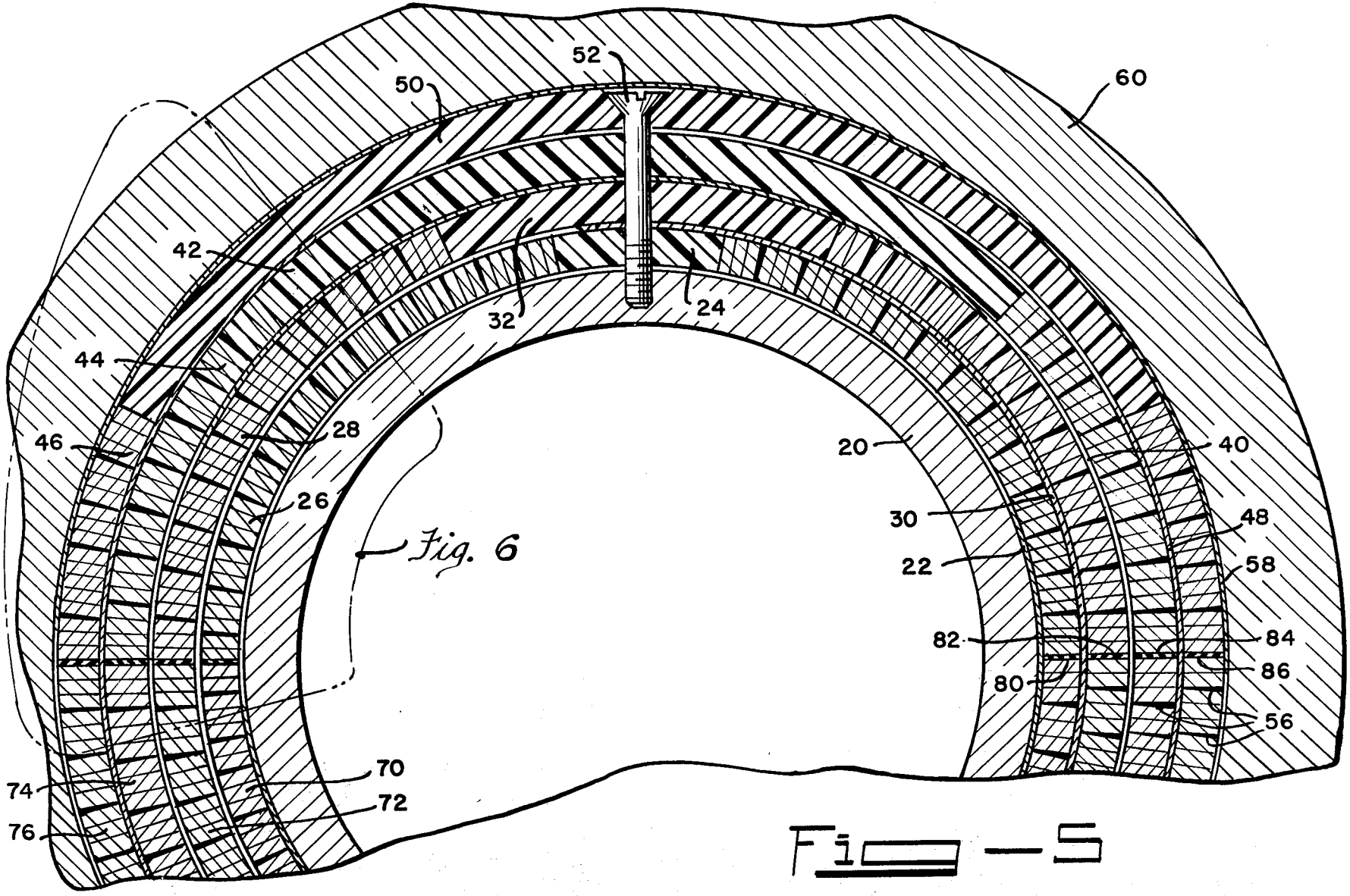
FIG. 5 is a partial sectional end view of the coils of FIG. 2 taken along section lines 5—5.
Figure 6:
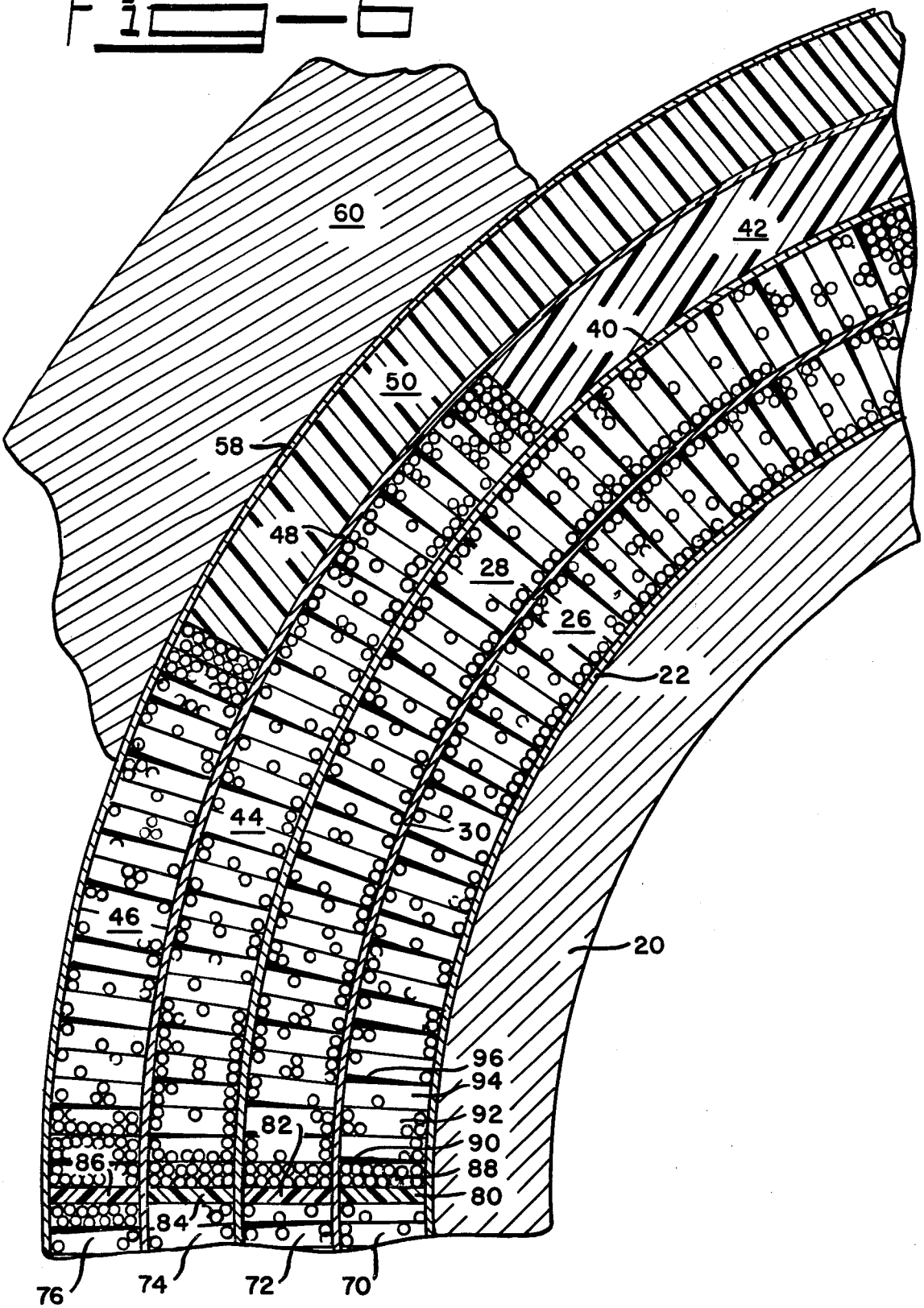
FIG. 6 is an expanded view of a portion of the view of FIG. 5 showing details of construction.

The views of FIGS. 2, 3 and 4 have concentrated upon structural details of the ends of the dipole windings of the present invention. In contrast, FIGS. 5 and 6 show the arrangement of windings in the central portion of the dipole magnet. FIG. 5 is a partial sectional view of the magnet of FIG. 2 taken along section lines 5—5 and FIG. 6 is an expanded view of an octant of the cross-section of FIG. 5 defined by section lines 6—6 of FIG. 5. FIG. 5 shows that the dipole magnet is wound on bore tube 20, a cylindrical shell that is separated by strip 22 from a second cylindrical shell, one-half of which is made up of first spacer 24 and first layer 26. A first layer 70 of the mirror-image half of the dipole is shown in FIG. 5. Strip 30 separates the cylindrical shell of the first layer from a second cylindrical shell comprising second spacer 32 and second layer 28 of one winding of the dipole, with second layer 72 of the lower half also shown. Strip 40 is wound spirally about that cylindrical shell and on it. Third spacer 42 is in the same cylindrical shell as third layer 44 of one winding and third layer 74 of the symmetrical winding. Strip 48 is wound spirally about that cylindrical shell and on it fourth spacer 50 provides a winding frame for fourth layer 46. Fourth layer 76 of the symmetrical dipole also appears in FIG. 5. Strip 58 is wound spirally to separate the final cylindrical shell from clamping tube 60. It can be seen from FIG. 5 that the cylindrical shells as viewed progressively outward from the center of the dipole have an increasingly smaller number of turns. This is a normal characteristic of such dipole windings. A particular example of such a dipole is listed in Table I which is a tabulation of the calculated number of windings for an embodiment of a four-layer superconducting dipole embodying the principles of the present invention. The calculational procedures are illustrated in further detail in FIG. 6 which is an expanded view of a particular segment comprising approximately an octant of FIG. 5 shown at an expanded scale. In FIG. 6, bore tube 20 and clamping tube 60 are seen to bound a structure that includes layers 26, 28, 44 and 46 of windings. Third spacer 42 and fourth spacer 50 are the only spacers visible of the four shown in FIG. 5. The layers of one portion of the superconducting dipole are separated from those of the other, respectively, by dividers 80, 82, 84 and 86, which are placed to fill each of the layers as necessary after each layer is wound and before it is cured. FIG. 6 also shows that in order to maintain a rigid structure of rectangles that are placed about a cylinder and to maintain the rectangles such that their long dimensions are substantially radial it is necessary to place wedges. This is shown schematically in FIG. 6 in one possible configuration and explicitly in Table I in another configuration. Referring to FIG. 6, beginning with divider 80 and proceeding circumferentially around first layer 26, the structure includes a winding 88, a wedge 90, a winding 92, a winding 94 and a wedge 96. This is a part of a pattern that is shown in detail for a particular embodiment of the invention in Table I which lists the following information for each layer of a dipole magnet. First, the total number of turns in each layer is listed. The inner and outer radii of each layer follows. Finally, the wedging scheme is detailed by listing the number of turns between wedges for each of the layers. Thus, referring to Table I, layer 1 has three turns, then a wedge, then five turns, then a wedge, and continuing as indicated in Table I until the total of 48 turns is placed and maintained in a good approximation to radial position. Table I also indicates that the calculations for field shaping required that the first three turns be split by placing a spacer having the cross-sectional area of a turn between the second and third turns. The figures of Table I are shown for illustrative purposes only. They are the results of the computer design of a particular coil. Various requirements of uniformity or field shape might lead another designer to different coil configurations within the scope of this invention.

TABLE I

| Layer | 1 | 2 | 3 | 4 |
|---|---|---|---|---|
| Turns | 48 | 45 | 33 | 21 |
| Inner radius (inches) | 3.50 | 3.89 | 4.28 | 4.67 |
| Outer radius (inches) | 3.86 | 4.25 | 4.64 | 5.03 |
| Number of turns between wedges, beginning at divider 80 | 3 | 3 | 2 | 2 |
| | 5 | 6 | 7 | * |
| | 5 | 5 | 7 | 1 |
| | 4 | 6 | 7 | 7 |
| | 5 | 5 | 7 | 7 |
| | 4 | 6 | 3 | 4 |
| | 5 | 5 | | |
| | 4 | 6 | | |
| | 5 | 3 | | |
| | 5 | | | |

*A spacer having the cross-sectional area of a turn is placed in the 4th layer between two cables to space them for proper field shaping.

The construction of the magnet shown herein permits the designer to interconnect the coils at their end connections in any fashion that is desired. The winding process described earlier leads to the completion of pairs of shells with one available terminal cable for each of the pairs. It is convenient to connect all of the strands in series with a pair of external leads and to make alternate connections of strands from different cables to maximize the speed of propagation of a quench. This is accomplished by separating the individual strands of the terminals of the cables and soldering them together in pairs in terminals 36 and 38. A quench is propagated most effectively by connecting a strand from first layer 26 to a strand from another layer such as second layer 28, third layer 44 or fourth layer 46. This pattern is alternated to approach as nearly as possible the ideal of having the entire coil go normal in the minimal amount of time whenever any portion of the coil leaves the superconducting region and goes normal. This minimizes the probability of localized thermal damage to the coil in the event of such a quench. It can be seen that a quench that begins at a particular spot in a particular cable will probably be propagated to each other strand in that cable since all of the strands are in physical contact. As soon as the quench propagates to the end of a cable and reaches terminal 36 or 38, it will be propagated into another layer because each of the strands of the cable that first began the quench is connected at terminal 36 or 38 to a strand of a cable in another layer of the magnet.

Figure 7:
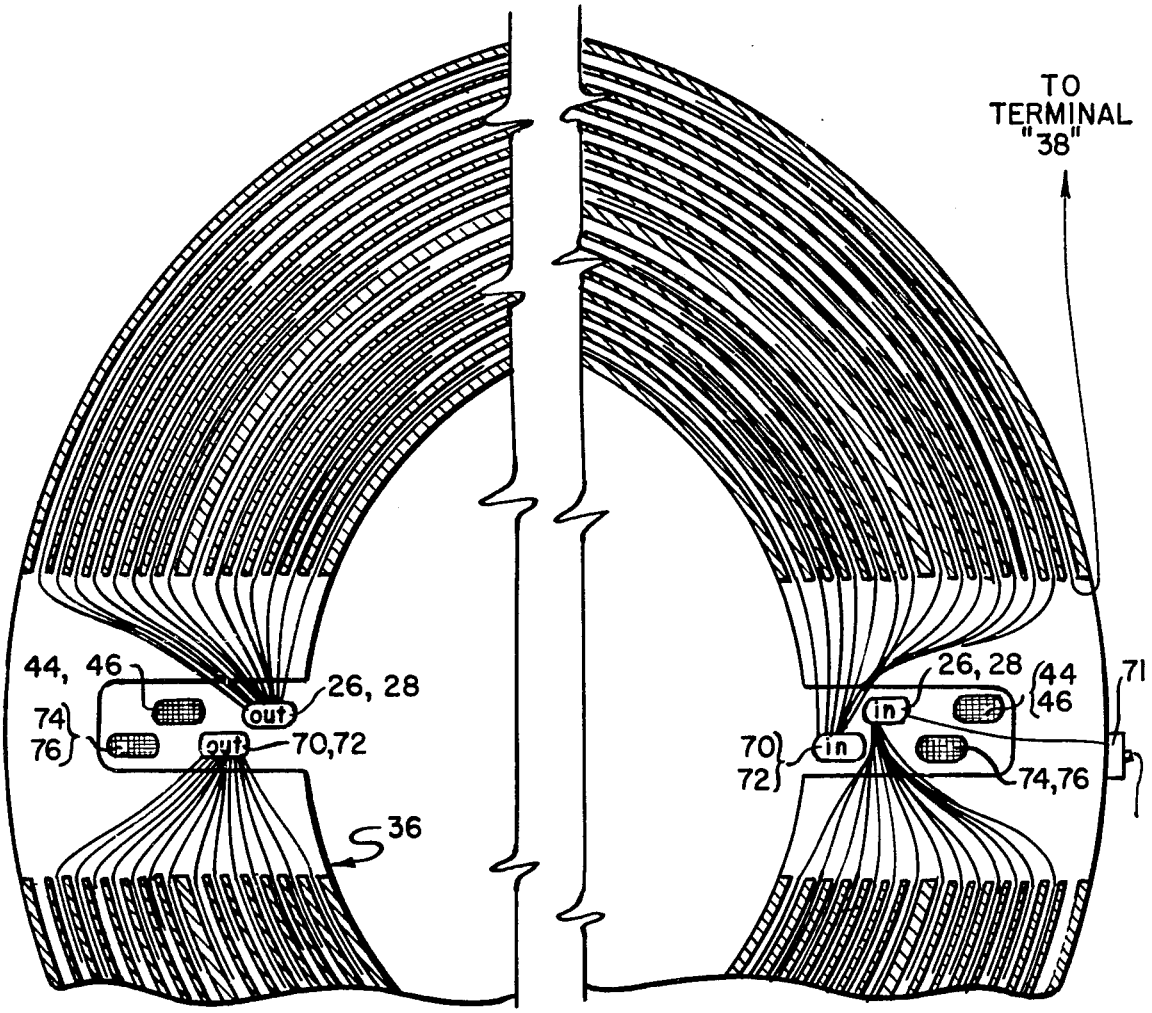
FIG. 7 is a partial sectional view of terminal 36 of FIG. 2 taken along section lines 7—7 of FIG. 2.
Figure 8:
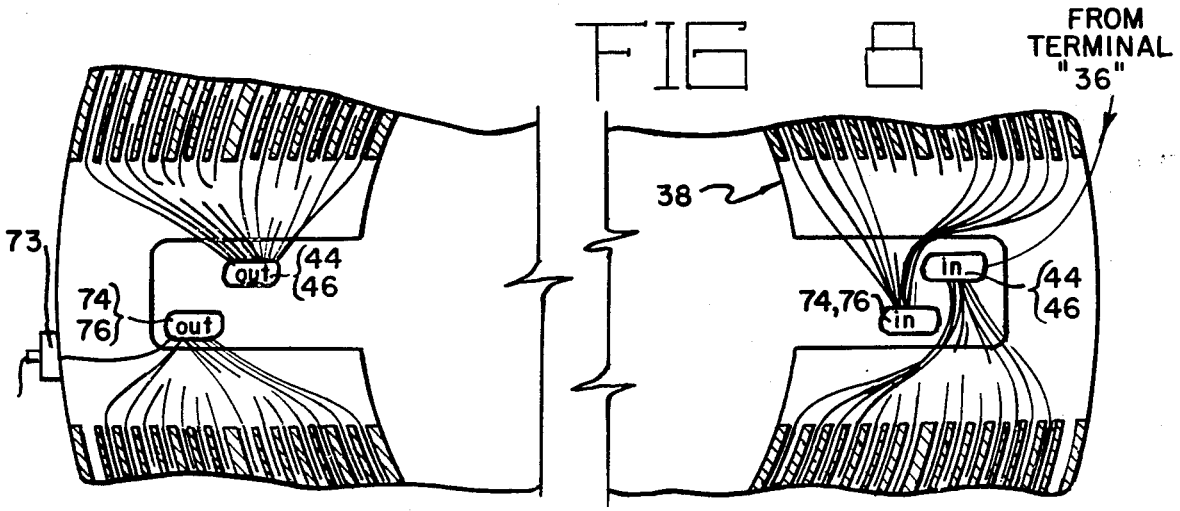
FIG. 8 is a partial sectional view of a portion of terminal 38 of FIG. 2 taken along section lines 8—8 of FIG. 2.

FIG. 7 is a partial sectional end view of terminal 36 of FIG. 2 taken along section lines 7—7 of FIG. 2 and FIG. 8 is a partial sectional view of terminal 38 of FIG. 2 taken along section lines 8—8 of FIG. 2. It has been noted earlier that layers 26 and 28 are wound with the beginning at the mid-point between them so that there is a single input terminal and a single output terminal that serves both layers 26 and 28. The same is true of layers 70 and 72, layers 44 and 46, and layers 74 and 76. The cables that are connected to each of these layers are cut in the sections of FIGS. 7 and 8. FIGS. 7 and 8 show the method of interconnecting the individual strands of the cable layers so as to make the series connections described above and so as also to connect one strand from a cable in one part in the magnet to a strand from another part of the magnet to assist in propagation of a quench. The fact of making such connections and the desirability of making them has been described above and the particular technique used for doing so is indicated in Table II.

TABLE II

Connections in Grooves of Terminals 36 and 38. Grooves are numbered radially outward in sequence. Strand 1 (In) of the cable of layer 26–28 is connected to first external terminal 71.

| | | | Out | | In | |
|---|---|---|---|---|---|---|
| Terminal | | Groove | Cable Layers | Strand | Cable Layers | Strand |
| | Top | 1 | 26–28 | 1 | 70–72 | 1 |
| | Bottom | 1 | 70–72 | 1 | 26–28 | 2 |
| | Top | 2 | 26–28 | 2 | 70–72 | 2 |
| | Bottom | 2 | 70–72 | 2 | 26–28 | 3 |
| 36 | Top | 3 | 26–28 | 3 | 70–72 | 3 |
| | Bottom | 3 | 70–72 | 3 | 26–28 | 4 |
| | . . . . . | | | | | |
| | Top | 14 | 26–28 | 14 | 70–72 | 14 |
| | Bottom | 14 | 70–72 | 14 | 26–28 | 15 |
| | Top | 15 | 26–28 | 15 | 70–72 | 15 |
| | Strand 15 (Out) of cable layer 70–72 is connected to strand 1 (In) of cable 44–46. | | | | | |
| | Top | 1 | 44–46 | 1 | 74–76 | 1 |
| | Bottom | 1 | 74–76 | 1 | 44–46 | 2 |
| | Top | 2 | 44–46 | 2 | 74–76 | 2 |
| | Bottom | 2 | 74–76 | 2 | 44–46 | 3 |
| 38 | Top | 3 | 44–46 | 3 | 74–76 | 3 |
| | Bottom | 3 | 74–76 | 3 | 44–46 | 4 |
| | . . . . . | | | | | |
| | Top | 14 | 44–46 | 14 | 74–76 | 14 |
| | Bottom | 14 | 74–76 | 14 | 44–46 | 15 |
| | Top | 15 | 44–46 | 15 | 74–76 | 15 |
| | Strand 15 (Out) of cable layer 74–76 is connected to second external terminal 73. | | | | | |

The grooves in terminals 36 and 38 that are shown in a side view in FIG. 2 are seen end on in FIGS. 7 and 8. In Table II these grooves are numbered radially in sequence beginning with the innermost groove and increasing numerically toward the outer circumference of terminals 36 and 38. As indicated earlier, individual strands are laid in the grooves and soldered together to make the series connection. Inspection of Table II shows that the continuing single series connection is made between strands from an upper cable and strands of a lower cable and that this pattern is repeated first in making the connections through terminal 36 and then in making the connections through terminal 38. First external terminal 71 and second external terminal 73 of FIG. 2 are then available for connection to an external supply to deliver current to the magnet.

Reference has been made earlier to an alternate embodiment of the invention in which one strand 12 of cable 10 of FIG. 1 is made of copper or some other normal electrical conductor. It may be desirable to use this embodiment in larger magnets to assist in rapid propagation of a quench. For this purpose, a quench detector is connected to a source of current for the magnet to provide a signal if the magnet begins to go normal. This detector is typically a voltage sensor, providing a signal upon detection of a non-zero voltage across the magnet. The signal from the quench detector is used to trigger an electrical source connected to the strand of normal conconductor, sending a current through the strand. The heat produced by that current in every part of cable 10 will quench the entire coil in a minimum time. This reduces the chance of damaging the coil by Joule heating at a small spot that goes normal for any reason. The strand may also be heated by switching means that direct coil current through the strand when a beginning quench is detected.

The embodiments of the invention in which an exclusive property or privilege is claimed are defined as follows:

1. A superconducting magnet formed on a cylindrical bore tube, the magnet comprising:

a. an open spiral of conducting tape wound on the bore tube;

b. an even number of saddle-shaped spacers disposed on the conducting tape, the number of spacers corresponding to the order of poles in the magnet;

c. a cable of strands of matrix superconducting material wound about the spacers to form saddle-shaped windings on a cylindrical surface tangent to the conducting tape;

d. a plurality of spacers disposed about the windings to complete with the windings a cylindrical surface;

e. a terminal receiving and interconnecting the strands of the cable in a pattern calculated to connect strands from different regions of the magnet to each other and to connect all strands together in series;

f. an external terminal pair connected to the terminal to supply electric current from an external source to the magnet; and g. means for maintaining the magnet at cryogenic temperatures.

2. The apparatus of claim 5 wherein the cable is a plurality of strands of matrix superconducting material twisted in a spiral, formed into a rectangular cross-section, and taped with an open spiral.

* * * * *